US012396572B2

(12) United States Patent
Fan

(10) Patent No.: US 12,396,572 B2
(45) **Date of Patent: *Aug. 26, 2025**

(54) BABY CARRYING HARNESS

(71) Applicant: WONDERLAND SWITZERLAND AG, Steinhausen (CH)

(72) Inventor: Meifeng Fan, Steinhausen (CH)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/646,400

(22) Filed: Apr. 25, 2024

(65) Prior Publication Data

US 2024/0292962 A1 Sep. 5, 2024

Related U.S. Application Data

(63) Continuation of application No. 17/582,938, filed on Jan. 24, 2022, now Pat. No. 11,992,133.

(30) Foreign Application Priority Data

Jan. 26, 2021 (CN) ..... 202110107661.4

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025; A44B 11/02
USPC ..... 224/60; D3/318
See application file for complete search history.

(56) References Cited

U.S. PATENT DOCUMENTS

| | | | |
|---|---|---|---|
| 3,739,961 | A | 6/1973 | Soukeras |
| D266,800 | S | 11/1982 | Kula et al. |
| 4,434,920 | A | 3/1984 | Moore |
| 4,579,264 | A | 4/1986 | Napolitano |
| 4,750,652 | A | 6/1988 | Grant |
| 5,211,321 | A | 5/1993 | Rodriguez |
| 5,947,552 | A | 9/1999 | Wilkins et al. |
| 6,152,342 | A | 11/2000 | Suk |

(Continued)

FOREIGN PATENT DOCUMENTS

| | | | |
|---|---|---|---|
| CN | 201691492 | U | 1/2011 |
| CN | 203041512 | U | 7/2013 |

(Continued)

OTHER PUBLICATIONS

Chinese Search Report issued from corresponding Chinese Application No. 202110107661.4, mailed Sep. 30, 2021, pp. 1-11.

(Continued)

*Primary Examiner* — Justin M Larson
(74) *Attorney, Agent, or Firm* — HAUPTMAN HAM, LLP

(57) ABSTRACT

A baby carrying harness includes a back carrying assembly being able to be worn on a user and a support sheet being connected to the back carrying assembly for carrying a baby. The back carrying assembly comprises a waist member and two shoulder strap members. The waist member is connected to a lower part of the support sheet. The back carrying assembly further includes a transition buckle connected to the waist member. A rear end of each of the shoulder strap members is configured to change direction by sliding through the transition buckle and then connecting to a middle of the support sheet.

19 Claims, 10 Drawing Sheets

(56) References Cited

U.S. PATENT DOCUMENTS

| | | | |
|---|---|---|---|
| D455,546 | S | 4/2002 | Norman |
| 6,481,606 | B2 | 11/2002 | Pickett |
| 6,530,129 | B1 | 3/2003 | Cheng |
| D611,699 | S | 3/2010 | Lundh |
| 7,766,199 | B1 | 8/2010 | Caperon |
| 8,418,897 | B1 | 4/2013 | Young |
| 8,579,168 | B2 | 11/2013 | Zack et al. |
| 9,357,852 | B2 | 6/2016 | Salazar et al. |
| D810,443 | S | 2/2018 | Burgess et al. |
| 10,245,486 | B2 | 4/2019 | Burgess et al. |
| 10,449,429 | B2 | 10/2019 | Bruce et al. |
| D876,824 | S | 3/2020 | Young |
| 10,610,002 | B2 | 4/2020 | Pacha et al. |
| 11,395,536 | B2 | 7/2022 | Pacha et al. |
| 11,559,728 | B2 | 1/2023 | Martell |
| D984,118 | S | 4/2023 | Fan |
| 11,992,133 | B2 * | 5/2024 | Fan ..... A47D 13/025 |
| 2005/0258202 | A1 | 11/2005 | Stevens et al. |
| 2008/0314940 | A1 | 12/2008 | Cohen Raz et al. |
| 2009/0026235 | A1 | 1/2009 | Gray |
| 2011/0062195 | A1 | 3/2011 | Jones et al. |
| 2011/0203531 | A1 | 8/2011 | Spinelli |
| 2012/0318833 | A1 | 12/2012 | Zack et al. |
| 2014/0263491 | A1 | 9/2014 | Telford et al. |
| 2016/0120334 | A1 | 5/2016 | Pond et al. |
| 2016/0227940 | A1 | 8/2016 | Wikner et al. |
| 2020/0297129 | A1 | 9/2020 | Schachtner |
| 2023/0106051 | A1 | 4/2023 | Martell |

FOREIGN PATENT DOCUMENTS

| | | | |
|---|---|---|---|
| CN | 104188423 | A | 12/2014 |
| CN | 204293323 | U | 4/2015 |
| CN | 108135370 | A | 6/2018 |
| CN | 109757929 | A | 5/2019 |
| CN | 109892909 | A | 6/2019 |
| CN | 110384365 | A | 10/2019 |
| CN | 211023339 | U | 7/2020 |
| CN | 211408344 | U | 9/2020 |
| CN | 111904213 | A | 11/2020 |
| CN | 111904214 | A | 11/2020 |
| DE | 202011104489 | U1 | 11/2012 |
| DE | 102012111052 | A1 | 5/2014 |
| EP | 3216372 | A1 | 9/2017 |
| JP | 2010524605 | A | 7/2010 |
| JP | 2011167494 | A | 9/2011 |
| JP | 2013118900 | A | 6/2013 |
| JP | 2013146399 | A | 8/2013 |
| JP | 2019076629 | A | 5/2019 |
| KR | 20160002472 | U | 7/2016 |
| TW | M320338 | U | 10/2007 |
| TW | M501788 | U | 6/2015 |
| WO | 2019009744 | A2 | 1/2019 |

OTHER PUBLICATIONS

Taiwanese First Office Action issued in corresponding Taiwanese Application No. 111102940, mailed Feb. 16, 2023, pp. 1-10.

Japanese Notice of Reasons for Refusal issued in corresponding Japanese Application No. 2022-008804, mailed Feb. 21, 2023, pp. 1-9.

Japanese Office Action issued from corresponding Japanese Application No. 2022-008804, mailed Aug. 8, 2023, pp. 1-10.

First Office Action in Corresponding Chinese Application No. 202110107661.4, dated Oct. 14, 2024; 23 pgs.

First Office Action in Corresponding Taiwan Application No. 113115128, dated Oct. 22, 2024; 7 pgs.

Notice of Allowance in Corresponding Korean Application No. 10-2022-0010616, dated Dec. 19, 2024; 5 pgs.

Second Office Action issued in Chinese Application No. 202110107661.4; mailed May 6, 2025; 24 pages.

* cited by examiner

BABY CARRYING HARNESS

CROSS REFERENCE TO RELATED APPLICATIONS

This application is a continuation application of U.S. application Ser. No. 17/582,938, filed Jan. 24, 2022, which claims priority to the Chinese Patent Application No. 202110107661.4, filed on Jan. 26, 2021, the entire content of which is incorporated herein in its entirety.

TECHNICAL FIELD

The present disclosure relates to baby products, and more particularly to an adjustable baby carrying harness.

BACKGROUND

Existing baby carrying harnesses can be divided into horizontal holding type, front carrying type, back carrying type, etc., according to different holding methods. Among them, the front carrying harness is most widely used due to its advantages facilitating operations and timely observation of babies.

In a front carrying harness, during a long time using, the user's shoulders will carry a larger load due to the baby's weight pulled forward. Moreover, in a cross-shaped formed by shoulder strap members crossed on back, the load on the user's shoulders can be partially dispersed on the back, thereby reducing the burden on the shoulders of the user and the fatigue of long-term use. Such shoulder strap members solve the problem of overloading on the user's shoulders to some extent; however, for users with different shoulder widths and different heights, in this kind of crossed shoulder strap members, because the position of the crossing point cannot be moved, positions of the shoulder strap members cannot be adjusted. Accordingly, users of different heights and shoulder widths cannot adjust or fix the crossing position to the best, so the purpose of reducing the burden on the user cannot be achieved.

For this, it is always believed in the industry, only such a baby carrying harness that is designed to distribute the burden of the baby to the user's shoulders, back and waist is the most practical and most easily promoted baby carrying harness.

Therefore, there is an urgent need for a baby carrying harness that can be adaptively adjusted according to the different body types of different users, such that the shoulders, backs and waists of the users can be uniformly stressed at the same time.

SUMMARY

An object of the disclosure to provide a baby carrying harness that can be adaptively adjusted according to the different body types of different users, such that the shoulders, backs and waists of the users can be uniformly stressed at the same time.

In order to achieve the above-mentioned object, the disclosure provides a baby carrying harness including a back carrying assembly being able to be worn on a user and a support sheet being connected to the back carrying assembly for carrying a baby. The back carrying assembly includes a waist member and two shoulder strap members, a front end of each of the shoulder strap members is connected to an upper part of the support sheet, a rear end of each of the shoulder strap members is connected to a middle of the support sheet, the two shoulder strap members crosswise and slidably pass through a shoulder strap fixing member, the shoulder strap members are crossed on the user's back through the shoulder strap fixing member, a crossing position of the two shoulder strap members is adjusted by sliding of the shoulder strap fixing member, and the waist member is connected to a lower part of the support sheet.

Compared with the related art, on the one hand, the shoulder strap members of the baby carrying harness of the disclosure are crossed on the user's back through the shoulder strap fixing member, the crossed structure not only distributes the load on the user's shoulders to the user's back, but also effectively prevents the shoulder strap members from slipping off, so as to improve the stability and firmness of the front carrying harness, and ensure that the baby is kept in a more stable position, thereby ensuring the safety of the baby. On the other hand, in the baby carrying harness of the disclosure, the crossing position of the two shoulder strap members are adjusted through sliding of the shoulder strap fixing member, so users with different shoulder widths and different heights can adaptively adjust the crossing position of the two shoulder strap members according to their actual conditions, such that the crossing position of the two shoulder strap members can be adjusted and fixed a carrying position suitable for the user's own conditions, such that the shoulders, backs and waists of the users can be uniformly stressed at the same time, the burden on the user's shoulders can be reduced and the user's fatigue feeling can be delayed.

Preferably, the shoulder strap fixing member of the disclosure has two crosswise channels for the two shoulder strap members to slidably pass through accordingly, and the two shoulder strap members accordingly pass through the channels crosswise.

Preferably, the shoulder strap fixing member of the disclosure is in a hollow structure, the shoulder strap fixing member defines through holes respectively penetrating the hollow structure in two crossing directions, and two of the through holes are directly opposite to each other and are used for a same one of the shoulder strap members to pass through.

Preferably, the shoulder strap fixing member of the disclosure is in a diamond structure.

Preferably, a larger inner angle of the diamond structure of the shoulder strap fixing member of the disclosure is 95°-115°, and more preferably is 105°.

Preferably, the shoulder strap fixing member of the disclosure is made of a TPE material. In selecting the TPE material selected for the shoulder strap fixing member, both flexibility and rigidity are taken into account, so as to satisfy requirements of both the comfort of the user and the stability of the structure.

Preferably, an inner side of the shoulder strap fixing member of the disclosure is covered with an ABS material layer. Specifically, the inner side of the shoulder strap fixing member is covered with an ABS material layer adjacent to the crossing of the shoulder straps, so as to strengthen the rigidity of the shoulder strap fixing member, thereby increasing the hardness of the structure of the shoulder strap fixing member, and further improving a firmness and durability of the baby carrying harness.

Preferably, the upper part of the support sheet of the disclosure and the front ends of the two shoulder strap members are in an integrated structure. The integrated structure reduces the use of the buckle components, makes the overall structure of the baby carrying harness more concise and convenient for storage and carrying.

Preferably, both ends of the upper part of the support sheet of the disclosure respectively extend independently to form the two shoulder strap members.

Preferably, the upper part of the support sheet of the disclosure and the front ends of the two shoulder strap members are fixedly connected to each other by sewing to form an integrated structure.

Preferably, the upper part of the support sheet of the disclosure and the front ends of the two shoulder strap members are in a detachable structure.

Preferably, each of the shoulder strap members of the disclosure is in an adjustable length structure. Users with different shoulder widths and different heights can adjust the length of the shoulder strap members, so as to achieve a best posture.

Preferably, the front end of each of the shoulder strap members of the disclosure is detachably connected to the upper part of the support sheet by a first fixing buckle being adjustable in length and capable of being snap-fit connected. The first fixing buckle facilitates the user to disassemble and separate the upper part of the support sheet from the front ends of the two shoulder strap members, so in using, the user only need to hold the baby to the front, then use the support sheet to cover the baby, and close the first fixing buckle, so a single person can complete the entire process of carrying the baby.

Preferably, the rear end of each of the shoulder strap members of the disclosure is detachably connected to the middle of the support sheet by a second fixing buckle being adjustable in length and capable of being snap-fit connected.

Preferably, both ends of the waist member of the disclosure are detachably connected by a third fixing buckle being adjustable in length and capable of being snap-fit connected.

Preferably, an adjustable fixing buckle for adjusting a width and a height of the support sheet is disposed in a connection between the waist member and the support sheet, the adjustable fixing buckle has a buckling state and an unlocking state, and the width and height of the support sheet are smaller when the adjustable fixing buckle is in the buckling state than the width and the height of the support sheet when the adjustable fixing buckle is in the unlocking state. The adjustable fixing buckle can adaptively adjust the width and the height of the support sheet according to the changes of the baby's body shape at different ages, so as to be more suitable for the baby's body shape, and especially to provide a more stable support for the baby's buttocks and leg, thereby providing a safer and more comfortable seating experience.

Preferably, the adjustable fixing buckle of the disclosure is any one of a drawstring, a cooperative button and a fixing ring, a plug-in buckle, a snap buckle, or a magic tape.

Preferably, the back carrying assembly of the disclosure further includes a transition buckle. The transition buckle is connected to the waist member, and the rear end of each of the shoulder strap members changes direction by sliding through the transition buckle and then connects to the middle of the support sheet. The rear end of each of the shoulder strap members forms a transitional connection with the waist member through the transition buckle, such that the shoulder strap members have a larger stressed area to cover the user's back, and further reduces the burden on the user's shoulders and waist, such that the user's shoulders, back and waist are more uniformly stressed at the same time.

Preferably, the rear end of each of the shoulder strap members of the disclosure is in a weaved strap structure, and the weaved strap structure slidably passes through the waist member.

Preferably, the carrying assembly of the disclosure back further includes a side shoulder strap, a front end of the side shoulder strap is connected to the upper part of the support sheet, and a rear end of the side shoulder strap is slidably connected to the rear end of one of the shoulder strap members. The side shoulder strap further strengthen the connection between the support sheet and the shoulder strap members, effectively preventing the baby from sliding off the side of the baby carrying harness, thereby further ensuring the safety of the baby.

Preferably, the back carrying assembly of the disclosure further includes a side shoulder strap. The sliding buckle slidably passes through the rear end of one of the shoulder strap members, and the sliding buckle is connected to the rear end of the side shoulder strap.

Preferably, the side shoulder strap of the disclosure and the support sheet are in an integrated structure.

DETAILED DESCRIPTION

Figure 1:
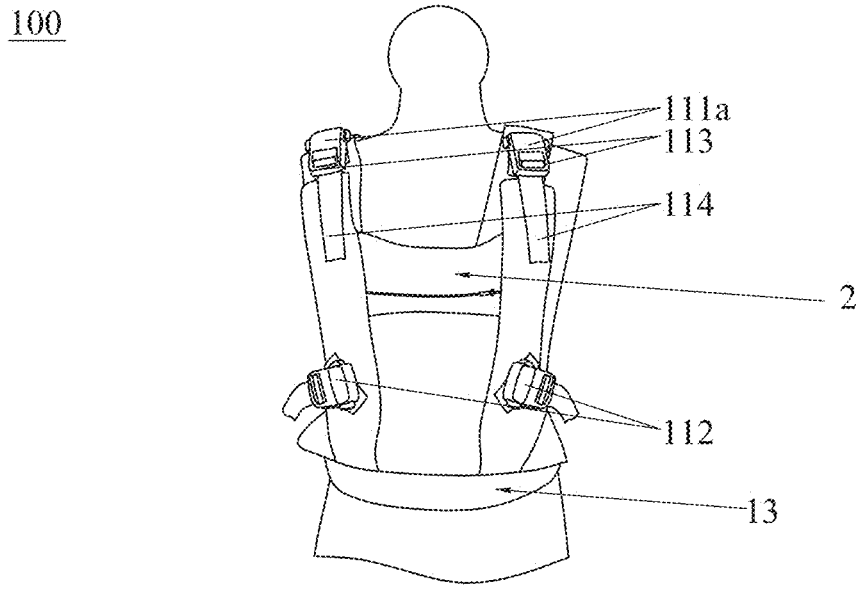
FIG. 1 is a schematic view of a front structure of a baby carrying harness according to a first embodiment of the disclosure.

In order to explain the technical content and structural features of the disclosure, the following description will be further provided in combination with the embodiment and the accompanying drawings.

As shown in FIGS. 1-3 and 6, a baby carrying harness 100 of the disclosure includes a back carrying assembly 1 that may be worn on a user and a support sheet 2 for carrying a baby that is connected to the back carrying assembly 1. The back carrying assembly 1 includes a waist member 13 and two shoulder strap members 11. A front end of each of the shoulder strap members 11 is connected to an upper part of the support sheet 2, and a rear end of each of the shoulder strap members 11 is connected to a middle of the support sheet 2. The two shoulder strap members 11 crosswise and slidably pass through a shoulder strap fixing member 12, and the shoulder strap members 11 are arranged crossed on the back of the user by the shoulder strap fixing member 12. A crossing position of the two shoulder strap members 11 is adjusted by sliding of the shoulder strap fixing member 12, and at the same time, by sliding of the shoulder strap fixing member 12, an adjustment of the distance between the two shoulder strap members 11 is realized. The waist member 13 is connected to a lower part of the support sheet 2. By arranging the shoulder strap members 11 in a crossed structure according to the disclosure, not only the loads on the shoulders of the user are well distributed on the user's back, but also the shoulder strap members 11 are effectively prevented from slipping off, so the shoulder strap members 11 are safe and reliable. At the same time, by sliding of the shoulder strap fixing member 12, the crossing position of the two shoulder strap members 11 may be adjusted in real time. Accordingly, users with different shoulder widths and different heights may adjust the crossing position of the two shoulder strap members 11, such that the crossing position of the two shoulder strap members 11 may be adjusted and fixed to a carrying position to carry load that is suitable for the user's own conditions, so the shoulders, backs and waists of the users may be uniformly stressed at the same time, and the burden on the user's shoulders may be reduced and the user's fatigue feeling may be delayed.

Figure 2:
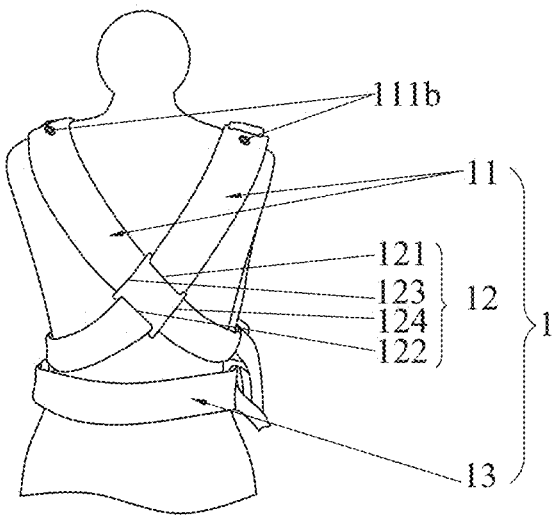
FIG. 2 is a schematic view of a back structure of the baby carrying harness according to the first embodiment of the disclosure.
Figure 6:
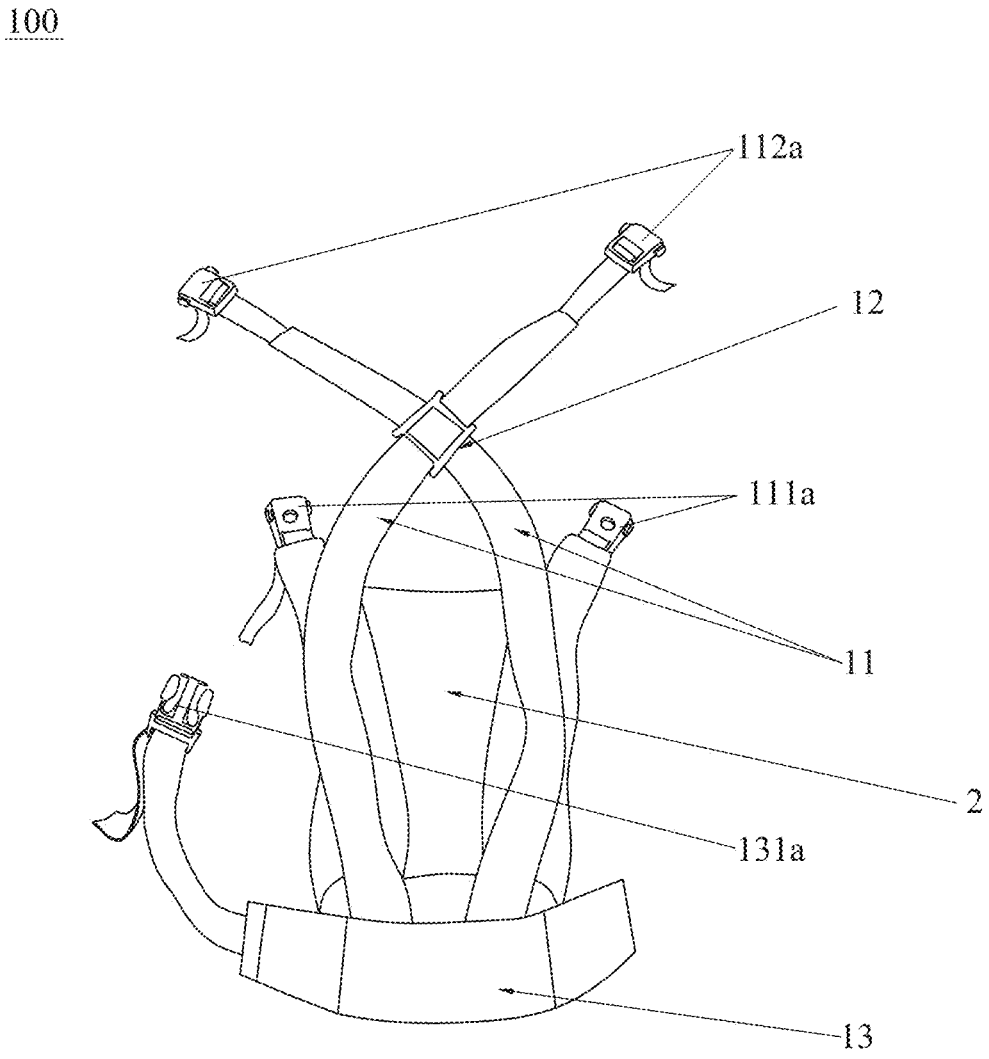
FIG. 6 is a schematic view of a back unfolded state of the first embodiment of the disclosure.

As shown in FIGS. 2 and 6, specifically, the shoulder strap fixing member 12 has two crosswise channels for the two shoulder strap members 11 to slidably pass through correspondingly, and the two shoulder strap members 11 accordingly sliding through the channels crosswise. Preferably, the shoulder strap fixing member 12 is in a hollow structure, and the shoulder strap fixing member 12 defines four through holes respectively penetrating the hollow structure in two crossing directions, i.e., a first through hole 121, a second through hole 122, a third through hole 123, and a fourth through hole 124. Among them, the first through hole 121 and the second through hole 122 are directly opposite, the third through hole 123 and the fourth through hole 124 are directly opposite, and the two through holes directly opposite to each other are used for the same shoulder strap member 11 to pass through.

Figure 7:
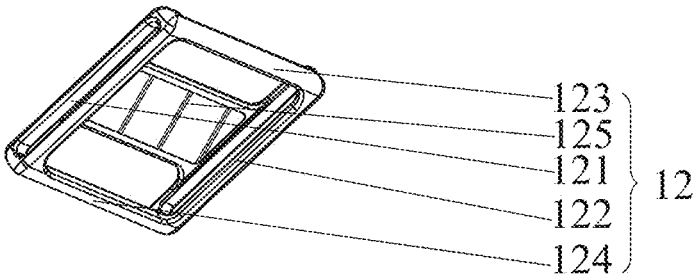
FIG. 7 is a schematic view of a front structure of a shoulder strap fixing member of the disclosure.
Figure 8:
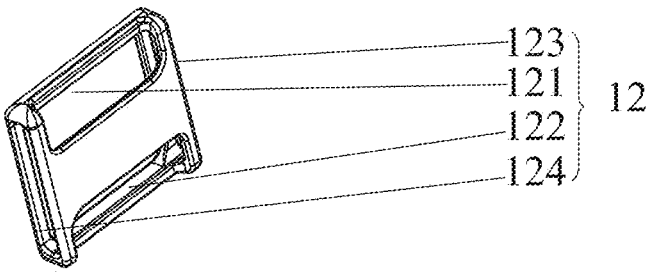
FIG. 8 is a schematic view of a back structure of the shoulder strap fixing member of the disclosure.

As shown in FIGS. 7 and 8, specifically, the shoulder strap fixing member 12 of the disclosure is in a diamond structure. More specifically, a larger inner angle of the diamond structure of the shoulder strap fixing member 12 of the disclosure is 105°. When selecting a material for the shoulder strap fixing member 12, it is necessary to take both flexibility and rigidity into account, so as to satisfy requirements of both the comfort of the user and the stability of the structure. Specifically, the shoulder strap fixing member 12 needs to strengthen rigidity at a position close to the crossing point of the shoulder straps. For example, the shoulder strap fixing member 12 of the disclosure is made of a TPE material. An inner side of the shoulder strap fixing member 12 is covered with an ABS material layer 125, so as to improve a hardness of the structure of the shoulder strap fixing member 12, thereby improving a firmness and durability of the baby carrying harness 100.

As shown in FIGS. 1 and 6, specifically, each of the shoulder strap members 11 is in an adjustable length structure, and users with different shoulder widths and different heights may adaptively adjust the lengths of the shoulder strap members 11 according to their actual conditions, so as to achieve a best posture. Specifically, the upper part of the support sheet 2 and the front end of each of the two shoulder strap members 11 are in a detachable structure. Specifically, the front end of each of the shoulder strap members 11 is detachably connected to the upper part of the support sheet 2 by a first fixing buckle 111 that is adjustable in length and capable of being snap-fit connected. Specifically, the first fixing buckle 111 includes a male buckle 111*a* and a female buckle 111*b* snap-fit connected to the male buckle 111*a*. Both ends of the upper part of the support sheet 2 are respectively connected to the male buckle 111*a*. A bottom of the male buckle 111*a* is connected to an "| |" shaped buckle 113 (the "日" shaped buckle 113 is a common buckle used for adjusting the length of a weaved strap). The female buckle 111*b* snap-fit connected to the male buckle 111*a* is fixed to the front end of one of the two shoulder strap members 11. By snap-fit connection of the male buckle 111*a* and the female buckle 111*b*, a detachable connection between the upper part of the support sheet 2 and the front ends of the two shoulder strap members 11 is achieved. More specifically, the "日" shaped buckle 113 is connected to a weaved strap structure 114, and a connection length between the upper part of the support sheet 2 and the front end of one of the shoulder strap members 11 may be adjusted by sliding of the "日" shaped buckle 113 on the weaved strap structure 114. Of course, the first fixing buckle 111 may also be a convenient and practical buckle such as a plug-in buckle, a snap buckle, a magic tape, a fixing buckle and a fixing hole, and the like. The first fixing buckle 111 may facilitate the user to disassemble and separate the upper part of the support sheet 2 from the front ends of the two shoulder strap members 11. In using, the user only needs to hold the baby to the front of his/her body, then use the support sheet 2 to cover the baby, and close the first fixing buckle 111, so a single person can complete the entire process of carrying the baby.

Figure 3:
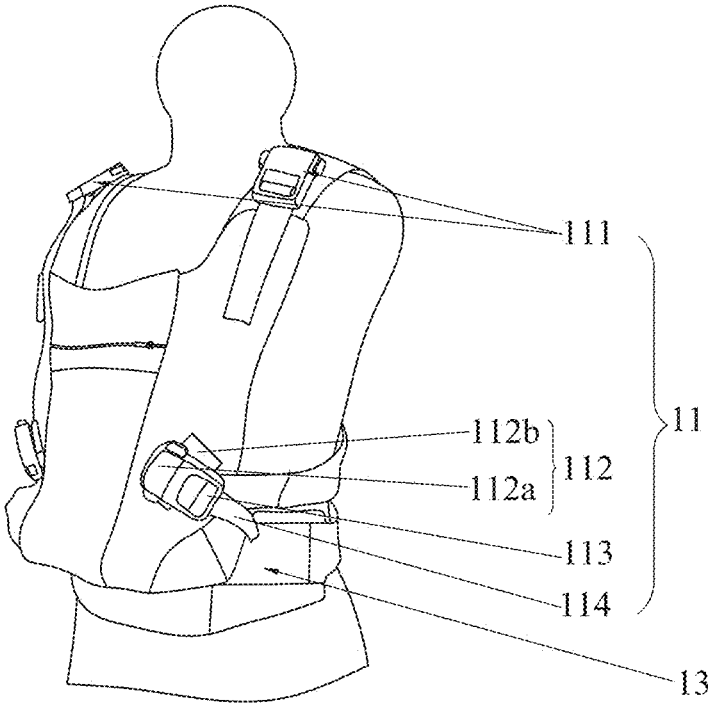
FIG. 3 is a schematic view of a side structure the baby carrying harness according to the first embodiment of the disclosure.
Figure 4:
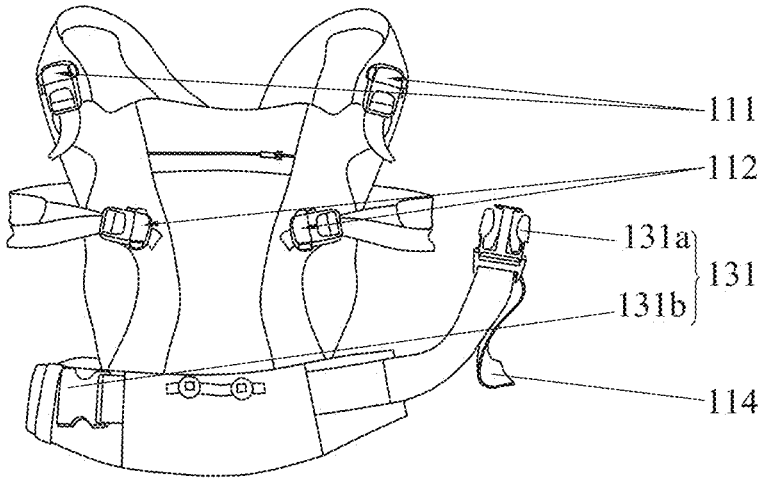
FIG. 4 is a schematic view of an unlocking state of an adjustable fixing buckle of the baby carrying harness of the disclosure.

As shown in FIGS. 3 and 4, a rear end of each of the shoulder strap member 11 and one end of the waist member 13 are in a weaved strap structure 114, the rear end of each of the shoulder strap members 11 is detachably connected to the middle of the support sheet 2 by a second fixing buckle 112 that is adjustable in length and may be snap-fit connected. Both ends of the waist member 13 are detachably connected by a third fixing buckle 131 that is adjustable in length and may be snap-fit connected. Specifically, each of the second fixing buckles 112 includes a male buckle 112*a* and a female buckle 112*b* that is snap-fit connected to the male buckle 112*a*. Each of the rear ends of the two shoulder strap members 11 is connected to one male buckle 112*a* by one "凵" shaped buckle 113, respectively. A length of each of the shoulder strap members 11 is adjusted by sliding of the "日" shaped buckle 113 on the weaved strap structure 114. The female buckles 112*b* snap-fit connected to the male buckles 112*a* are fixed on both sides of the middle of the support sheet 2. By the snap-fit connections of the male buckles 112*a* and the female buckles 112*b*, the detachable connections between the rear ends of the shoulder strap members 11 and the middle of the support sheet 2 are achieved. The third fixing buckle 131 includes a male buckle 131*a* and a female buckle 131*b* that is snap-fit connected to the male buckle 131*a*, and one end of the waist member 13 is connected to one male buckle 131*a* by one "凵" shaped buckle 113. By sliding of the "日" shaped buckle 113 on the weaved strap structure 114, a length of the waist member 13 is adjusted. The female buckle 131*b* snap-fit connected to the male buckle 131*a* is fixed to the other one end of the waist member 13. By the snap-fit connection of the male buckle 131*a* and the female buckle 131*b*, detachable connections of the two ends of the waist member 13 are achieved. Of course, the second fixing buckle 112 or the third fixing buckle 131 may also be a convenient and practical buckle such as a plug-in buckle, a snap buckle, a magic tape, a fixing buckle and a fixing hole, and the like.

Figure 5:
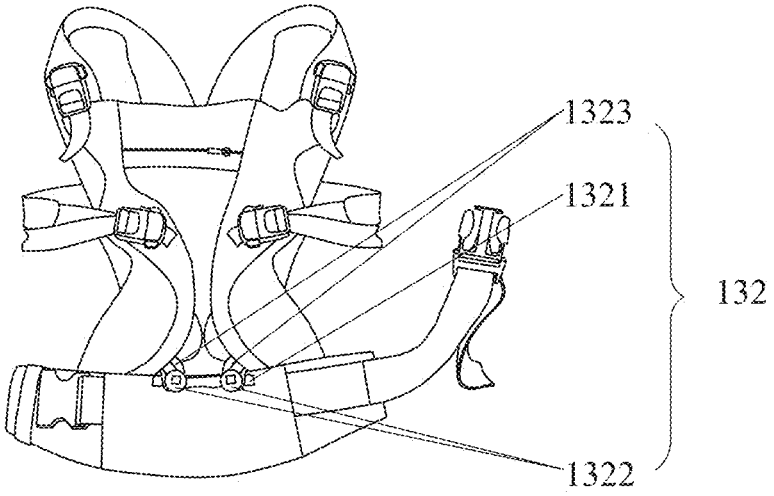
FIG. 5 is a schematic view of a buckling state of the adjustable fixing buckle of the baby carrying harness of the disclosure.

As shown in FIGS. 4 and 5, according to the disclosure, an adjustable fixing buckle 132 for adjusting a width and a height of the support sheet 2 is disposed in the connection between the waist member 13 and the lower part of the support sheet 2. The adjustable fixing buckle 132 has a buckling state and an unlocking state, and the width and the height of the support sheet 2 are smaller when the adjustable fixing buckle 132 is in the buckling state than the width and the height of the support sheet 2 when the adjustable fixing buckle 132 is in the unlocking state. As shown in FIG. 4, the adjustable fixing buckle 132 is in the unlocking state, both the width and the height of the lower part of the support sheet 2 are relatively large, so a larger baby may be covered. As shown in FIG. 5, the adjustable fixing buckle 132 is in the buckling state, such that both the width and the height of the lower part of the support sheet 2 are reduced, so it may be used for a smaller baby. More specifically, the adjustable fixing buckle 132 may include a drawstring 1321, and cooperatively a button 1322 and a fixing ring 1323. When the button 1322 is buckled in the fixing ring 1323, the drawstring 1321 pulls the support sheet 2 to fold to reduce its width and height. When the button 1322 is separated from the fixing ring 1323 to be unlocked, the support sheet 2 restores to its original width and height. Of course, the adjustable fixing buckle 132 may also be a convenient and practical buckle such as a plug-in buckle, a snap or a magic tape or the like. The adjustable fixing buckle 132 may adaptively adjust the width and height of the support sheet 2 according to the changes of the baby's body shape at different ages, which is more suitable for the baby's body shape, and especially supports the baby's buttocks and legs more firmly, thereby providing a safer and more comfortable seating experience.

According to the disclosure, the shoulder strap members 11 of the baby carrying harness 100 are crossed in respect to each other on the back of the user by the shoulder strap fixing member 12, such a crossed structure not only distributes the load on the user's shoulders to the user's back, but also effectively prevents the shoulder strap members 11 from slipping off, so as to improve the stability and firmness of the front carrying harness, and ensure that the baby is kept in a more stable position, thereby ensuring the safety of the baby. On the other hand, in the baby carrying harness 100 of the disclosure, the crossing position of the two shoulder strap members 11 are adjusted through sliding of the shoulder strap fixing member 12, so users with different shoulder widths and different heights may adaptively adjust the crossing position of the two shoulder strap members 11 according to their actual conditions, such that the crossing position of the two shoulder strap members 11 may be adjusted and fixed to a carrying position suitable for the user's own conditions, such that the shoulders, backs and waists of the users may be uniformly stressed at the same time, the burden on the user's shoulders may be reduced and the user's fatigue feeling may be delayed.

Figure 9:
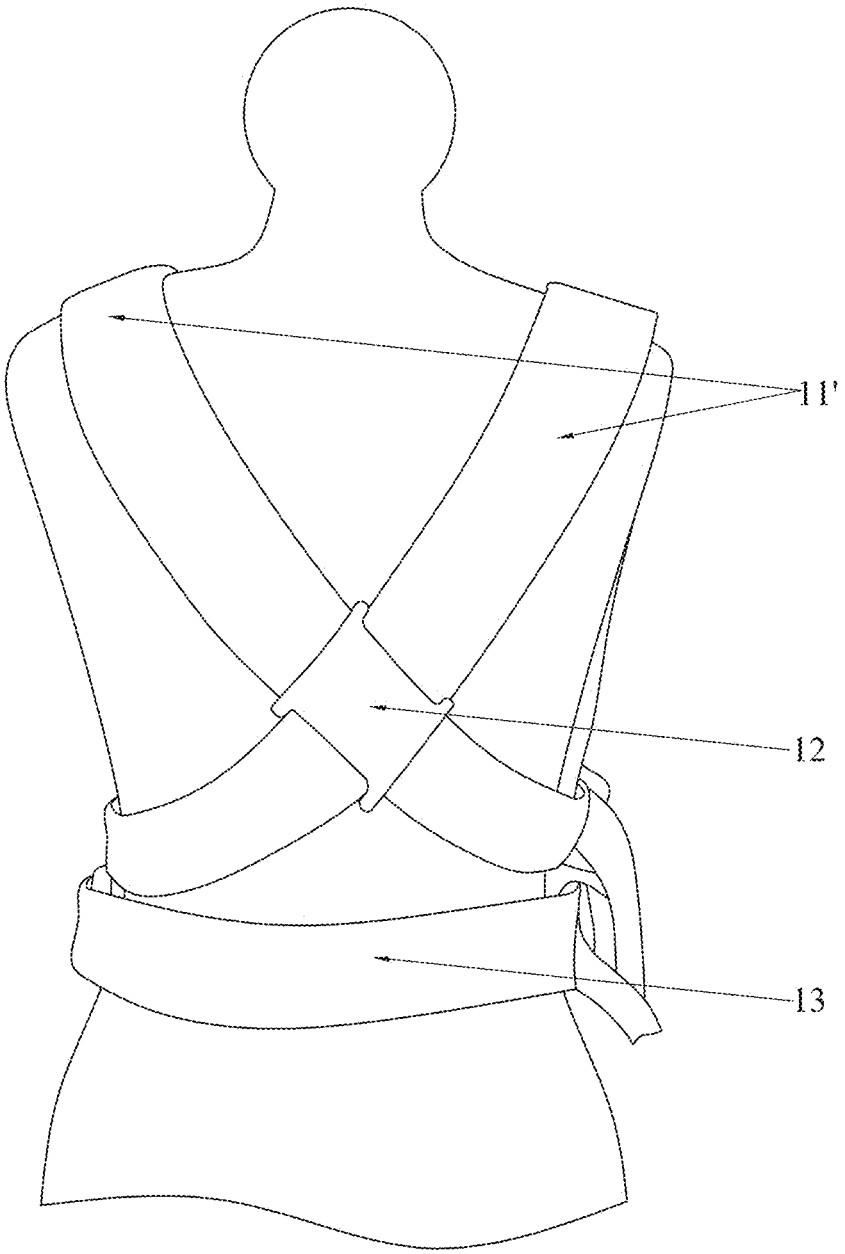
FIG. 9 is a schematic view of a front structure of a second embodiment of the disclosure.
Figure 10:
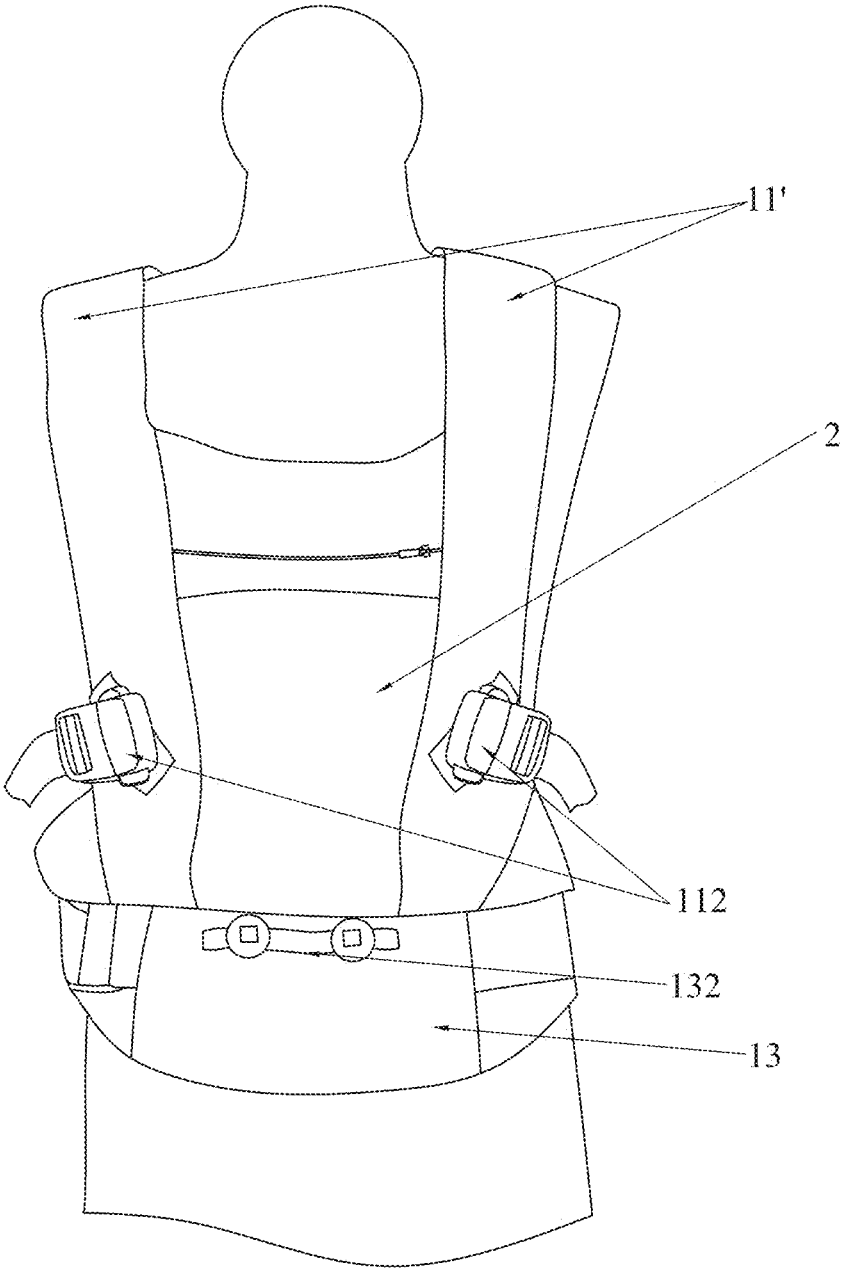
FIG. 10 is a schematic view of a back structure of the second embodiment of the disclosure.
Figure 11:
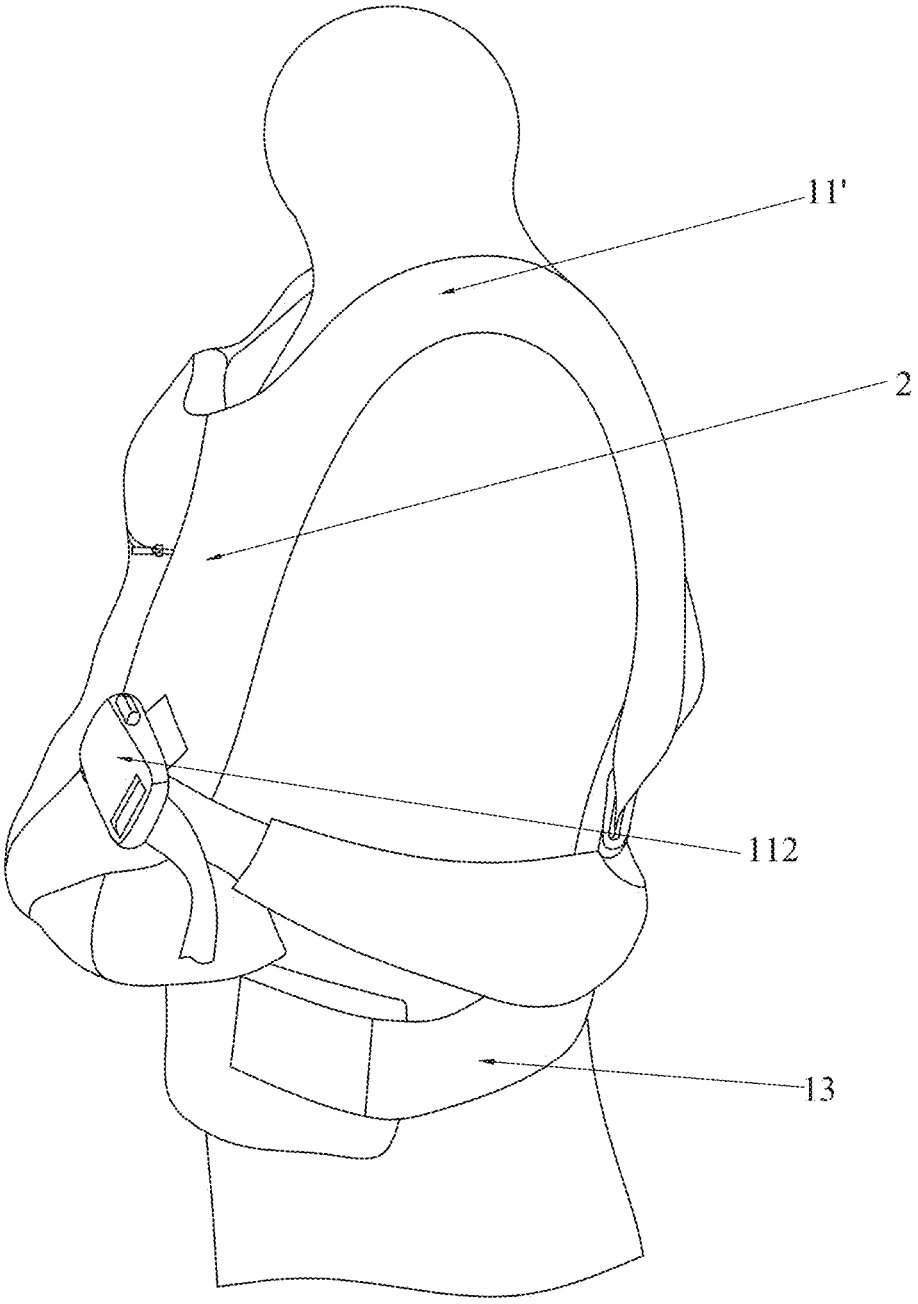
FIG. 11 is a schematic view of a side structure of the second embodiment of the disclosure.

As shown in FIGS. 9-11, according to the second embodiment of disclosure, the upper part of the support sheet 2 and the front ends of the two shoulder strap members 11' are in an integrated structure, and both ends of the upper part of the support sheet 2 respectively extend independently to form the two shoulder strap members 11'. In using, the two shoulder strap members 11' are wound to the front and are detachably connected to the middle of the support sheet 2 by the second fixing buckle 112 whose length is adjustable and may be snap-fit connected. Of course, the upper part of the support sheet 2 and the front ends of the two shoulder strap members 11' may also be fixedly connected to each other by sewing to form an integrated structure, however, the disclosure is not limited to the specific method for achieving the integrated structure of the upper part of the support sheet 2 and the front ends of the two shoulder strap members 11'. The integrated structure may reduce the use of buckle components, makes the overall structure of the baby carrying harness 100 more concise and convenient for storage and carrying.

Figure 12:
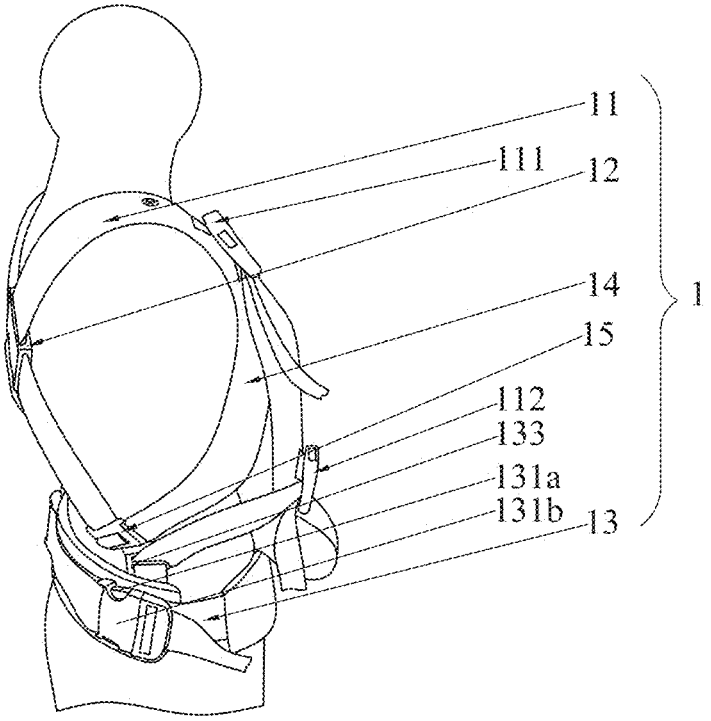
FIG. 12 is a schematic view of a side structure of a third embodiment of the disclosure.
Figure 13:
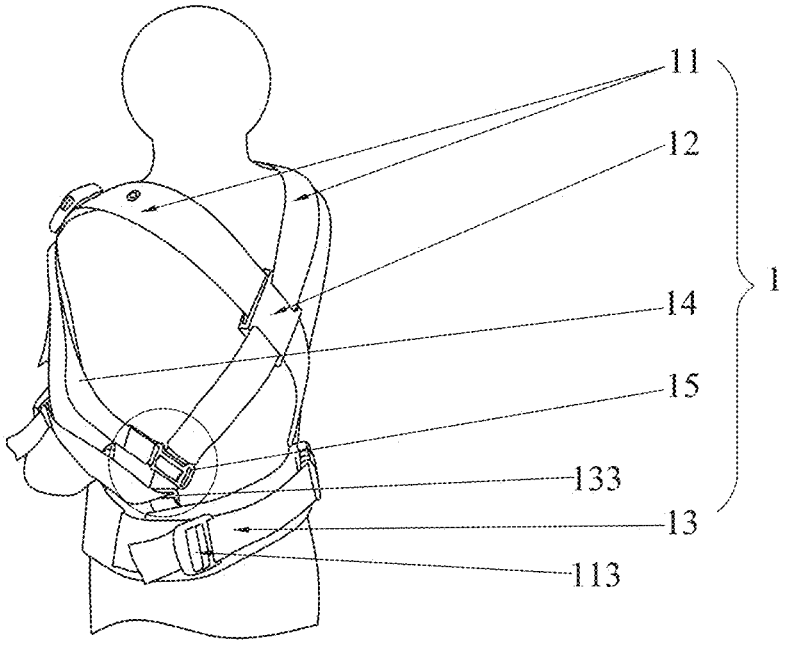
FIG. 13 is a schematic view of a back structure of the third embodiment of the disclosure.
Figure 14:
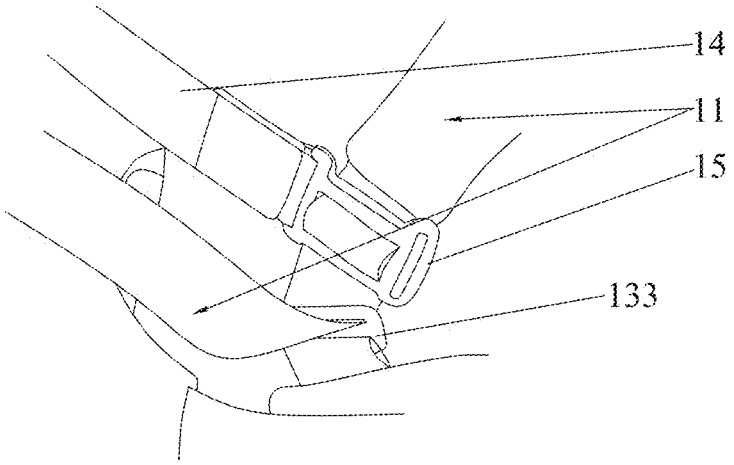
FIG. 14 is a partial enlarged schematic view of connections of a transition buckle and a sliding buckle in FIG. 13.

As shown in FIGS. 12-14, according to the third embodiment of the disclosure, the back carrying assembly 1 further includes a transition buckle 133, a sliding buckle 15, and side shoulder straps 14. The transition buckle 133 is connected to the waist member 13. The rear end of each of the shoulder strap members 11 changes direction by sliding through the transition buckle 133 and then connects to the middle of the support sheet 2. The sliding buckle 15 slidably passes through the rear end of one of the shoulder strap members 11. The sliding buckle 15 is connected to a rear end of each of the side shoulder straps 14, and a front end of each of the side shoulder straps 14 is connected to the upper part of the support sheet 2. Moreover, the rear end of each of the side shoulder straps 14 is slidably connected to the rear end of one of the shoulder strap members 11 by the sliding buckle 15. Specifically, the side shoulder straps 14 and the support sheet 2 form an integrated structure. The rear end of each of the shoulder strap members 11 forms a transitional connection with the waist member 13 through the transition buckle 133, such that the shoulder strap members 11 have a larger stressed area, and further reduces the burden on the user's shoulders and waist, such that the user's shoulders, back and waist are more uniformly stressed at the same time. The side shoulder straps 14 further strengthens the connection between the support sheet 2 and the shoulder strap members 11, effectively preventing the baby from sliding off the side of the baby carrying harness 100, thereby further ensuring the safety of the baby. Specifically, the rear end of each of the shoulder strap members 11 is in the weaved strap structure 114, and the weaved strap structure 114 slidably passes through the waist member 13.

As shown in FIGS. 1-14, in the baby carrying harness 100 of the disclosure, the shoulder strap members 11 are crossed on the user's back through the shoulder strap fixing member 12, which may well disperse the load on the user's shoulders to the user's back, and effectively prevent the shoulder strap members 11 from slipping off, so as to improve the stability and firmness of the front carrying harness, and ensure that the baby is kept in a more stable position, thereby ensuring the safety of the baby. On the other hand, the baby carrying harness 100 of the disclosure may adjust the crossing position of the two shoulder strap members 11 by sliding of the shoulder strap fixing member 12, so users of different shoulder widths and different heights may adaptively adjust the crossing position of the two shoulder strap members 11 according to their own actual conditions, such that the shoulders, backs and waists of the users may be uniformly stressed at the same time, the burden on the user's shoulders may be reduced and the user's fatigue feeling may be delayed. Moreover, by the snap-fit connections between the male buckles and the female buckles of the first fixing buckle 111, the second fixing buckle 112, and the third fixing buckle 131, quick detached separations between various components may be achieved, such that the operation to carry the baby by using the baby carrying harness 100 will be more convenient and quicker; furthermore, the adjustable fixing buckle 132 may adaptively adjust the width and height of the support sheet 2 according to changes in the body shapes of babies of different ages, so the baby carrying harness 100 is more versatile.

What disclosed above are only preferred embodiments of the disclosure, and the scope of the disclosure certainly cannot be limited by this. Therefore, any equivalent changes made according to the scope of the disclosure still belong to the disclosure.

What is claimed is:

1. A baby carrying harness comprising:

a back carrying assembly being able to be worn on a user and a support sheet being connected to the back carrying assembly for carrying a baby, wherein the back carrying assembly comprises a waist member and two shoulder strap members, the waist member is connected to a lower part of the support sheet, the back carrying assembly further comprises a transition buckle connected to the waist member, and a rear end of at least one of the shoulder strap members is configured to change direction by sliding through the transition buckle and then connecting to a middle of the support sheet.

2. The baby carrying harness according to claim 1, wherein the two shoulder strap members crosswise and slidably pass through a shoulder strap fixing member, the shoulder strap fixing member has two crosswise channels for the two shoulder strap members to slidably pass through accordingly, and the two shoulder strap members accordingly pass through the channels crosswise.

3. The baby carrying harness according to claim 1, wherein the two shoulder strap members crosswise and slidably pass through a shoulder strap fixing member, the shoulder strap fixing member is in a hollow structure, the shoulder strap fixing member defines through holes correspondingly penetrating the hollow structure in two crossing directions, and two of the through holes are directly opposite to each other and are used for a same one of the shoulder strap members to pass through.

4. The baby carrying harness according to claim 1, wherein the two shoulder strap members crosswise and slidably pass through a shoulder strap fixing member, and the shoulder strap fixing member is in a diamond structure.

5. The baby carrying harness according to claim 4, wherein a larger inner angle of the diamond structure is 95°-115°.

6. The baby carrying harness according to claim 1, wherein the two shoulder strap members crosswise and slidably pass through a shoulder strap fixing member, and the shoulder strap fixing member is made of a TPE material.

7. The baby carrying harness according to claim 1, wherein the two shoulder strap members crosswise and slidably pass through a shoulder strap fixing member, and an inner side of the shoulder strap fixing member is covered with an ABS material layer.

8. The baby carrying harness according to claim 1, wherein an upper part of the support sheet and front ends of the two shoulder strap members are in an integrated structure.

9. The baby carrying harness according to claim 8, wherein both ends of the upper part of the support sheet respectively extend independently to form the two shoulder strap members.

10. The baby carrying harness according to claim 8, wherein the upper part of the support sheet and the front ends of the two shoulder strap members are fixedly connected to each other by sewing to form an integrated structure.

11. The baby carrying harness according to claim 1, wherein an upper part of the support sheet and front ends of the two shoulder strap members are in a detachable structure.

12. The baby carrying harness according to claim 1, wherein each of the shoulder strap members is in an adjustable length structure.

13. The baby carrying harness according to claim 11, wherein the front end of each of the shoulder strap members is detachably connected to the upper part of the support sheet by a first fixing buckle being adjustable in length and capable of being snap-fit connected.

14. The baby carrying harness according to claim 1, wherein the rear end of each of the shoulder strap members is detachably connected to the middle of the support sheet by a second fixing buckle being adjustable in length and capable of being snap-fit connected.

15. The baby carrying harness according to claim 1, wherein both ends of the waist member are detachably connected by a third fixing buckle being adjustable in length and capable of being snap-fit connected.

16. The baby carrying harness according to claim 1, wherein an adjustable fixing buckle has a buckling state and an unlocking state, and a width and a height of the support sheet when the adjustable fixing buckle is in the buckling state are smaller than the width and the height of the support sheet when the adjustable fixing buckle is in the unlocking state.

17. The baby carrying harness according to claim 16, wherein the adjustable fixing buckle further includes a drawstring.

18. The baby carrying harness according to claim 1, wherein a front end of each of the shoulder strap members is connected to an upper part of the support sheet, and the rear end of each of the shoulder strap members is connected to the middle of the support sheet.

19. The baby carrying harness according to claim 1, wherein the two shoulder strap members crosswise and slidably pass through a shoulder strap fixing member, and the shoulder strap members are configured to be crossed on the user's back by the shoulder strap fixing member.

* * * * *